US005492372A

United States Patent [19]

Dranberg

[11] Patent Number: 5,492,372

[45] Date of Patent: Feb. 20, 1996

[54] SPLIT REPLACEMENT FLANGE FOR WATER CLOSET AND METHOD OF REPLACING

[76] Inventor: Gary Dranberg, 17648 N. 35th St., Phoenix, Ariz. 85032

[21] Appl. No.: 330,747

[22] Filed: Oct. 28, 1994

[51] Int. Cl.[6] ..... E03D 11/00; F16L 55/00

[52] U.S. Cl. ..... 285/56; 4/252.1; 4/252.4; 285/15; 285/415

[58] Field of Search ..... 285/15, 16, 17, 285/56–60, 415; 4/252.1, 252.4, 252.5, 252.6, 419, 661

[56] References Cited

U.S. PATENT DOCUMENTS

| | | | |
|---|---|---|---|
| 1,019,766 | 3/1912 | Cronk | 4/252.1 |
| 1,031,531 | 7/1912 | Cramer | 285/56 |
| 1,613,926 | 1/1927 | Bropson . | |
| 1,784,667 | 12/1930 | Gillet | 285/415 |
| 2,082,348 | 6/1937 | Le Tarte | 285/56 |
| 2,911,239 | 11/1959 | Marzolf, Sr. | 285/415 |
| 3,319,268 | 5/1967 | Blumenkranz | 4/252 |
| 3,761,114 | 9/1973 | Blakeley | 285/111 |
| 3,775,780 | 12/1973 | McEwan | 4/252 |
| 4,207,630 | 6/1980 | Bressler | 4/252 |
| 4,886,302 | 12/1989 | Forbes | 285/56 |
| 5,220,694 | 6/1993 | Knorovsky | 4/252.1 |
| 5,246,255 | 9/1993 | Forbes et al. | 285/24 |
| 5,309,579 | 5/1994 | Nelson | 285/58 |
| 5,335,849 | 8/1994 | Forbes | 285/12 |

OTHER PUBLICATIONS

Grabler Mfg. Comp. Catalog 5th Issue, 1936 pp. 122 and 102. TJ 418 G73; 285/42.

*Primary Examiner*—Eric K. Nicholson
*Attorney, Agent, or Firm*—Frank J. McGue

[57] ABSTRACT

A replacement ring and method therefor is disclosed for use in connection with a water closet coupling having flange portion, a connection section and a mounting ring interposed between a toilet drain and a sewer pipe. The mounting ring mounts the coupling to the toilet and to a floor proximate to the sewer pipe. The inner diameter of the mounting ring engages a channel on the coupling for mounting thereto. The replacement ring comprises two joined, overlapping arcuate pieces positioned on opposing sides of the coupling. The inner diameter of the joined arcuate pieces engages the channel on the coupling for mounting thereto. The replacement ring is mounted to both the toilet and to the floor.

10 Claims, 2 Drawing Sheets

SPLIT REPLACEMENT FLANGE FOR WATER CLOSET AND METHOD OF REPLACING

TECHNICAL FIELD

This invention relates to an improved replacement ring for use in plumbing devices, and, more particularly, for replacement of a steel ring used to mount plastic closet couplings which connect toilet fixtures to sewer pipes.

BACKGROUND OF THE INVENTION

Plastic closet couplings are commonly used to connect toilet drains to sewer pipes in homes and the like. These couplings comprise a plastic flange, a connector and a steel ring mounted thereto which is sold as a single unit. The steel ring generally includes means for mounting the closet coupling to the sewer pipe to maintain the coupling in the proper location beneath a toilet. U.S. Pat. No. 3,775,780 entitled "Water Closet Coupling" which issued Dec. 4, 1973 to McEwan provides a description of the above system.

However, it has been found that the steel ring which surrounds the plastic closet flange often rusts through, particularly in the vicinity of holes provided in the steel ring. The rusted steel ring cannot maintain the seal between the plastic coupling and the toilet drain resulting in unsanitary water leakage. To rectify, the coupling must be repaired.

DESCRIPTION OF THE PRIOR ART

Heretofore, repairs have generally involved replacement of the entire closet flange/steel ring coupling rather than just the rusted ring. However, a number of patents have been directed towards repairing the rusted steel ring rather than replacement of the entire coupling.

U. S. Pat. No. 4,207,630 describes an arcuate spanner flange which bridges the gap defined by the rusted section of the steel ring. However, the spanner flange does not provide lateral movement restraint and thus the spanner flange may be dislodged eventually.

U. S. Pat. No. 5,220,694 describes an anchoring device and method for anchoring the toilet to a broken water closet ring. Two arcuate members are formed at the same outer diameter as the closet flange. However, as with the spanner flange of U.S. Pat. No. 4,207,630, this device does not replace the rusted steel ring but is secured thereto. The rusting process can continue unabated on the steel ring which eventually may allow the repair flange to also become dislodged.

None of the known prior art disclose the device set forth herein.

SUMMARY OF THE INVENTION

It is an object of this invention to provide a replacement flange for use with plastic water coupling devices used to connect toilet drains to sewer lines.

It is a further object of this invention to provide a simple device for easy replacement of the steel ring used to mount water coupling devices.

Further objects and advantages of the invention will become apparent as the following description proceeds and the features of novelty which characterize this invention will be pointed out with particularity in the claims annexed to and forming a part of this specification.

BRIEF DESCRIPTION OF THE DRAWINGS

The present invention may be more readily described by reference to the accompanying drawings in which.

DESCRIPTION OF THE PREFERRED EMBODIMENT

Figure 6:
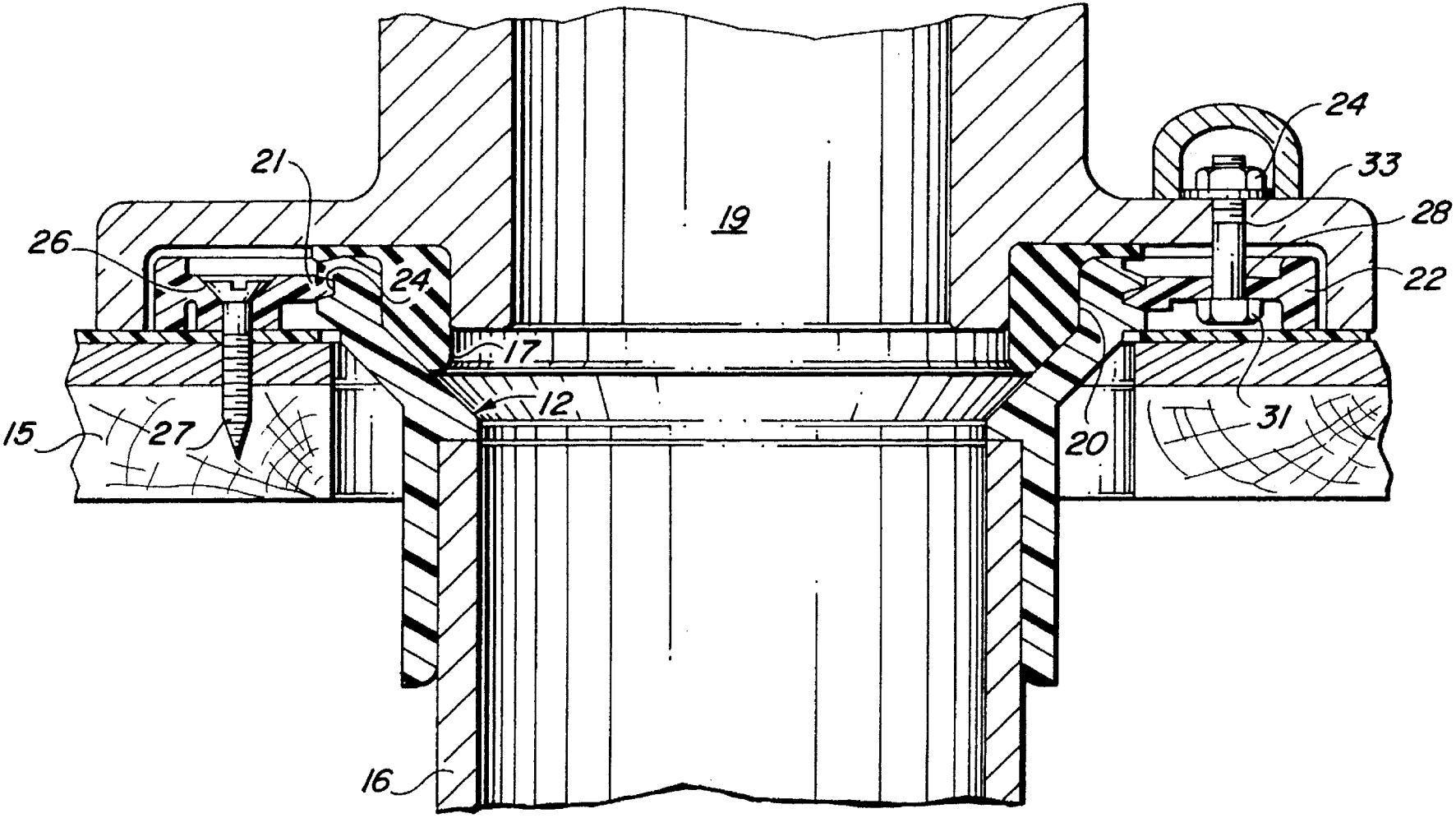
FIG. 6 (PRIOR ART)
FIG. 6 is a cross sectional side view of a typical closet coupling.

Referring more particularly to the drawings by characters of reference, FIGS. 1–5 disclose a replacement ring 10 for use in connection with a water closet coupling 12. As best seen in FIG. 6, the water closet coupling 12 generally comprises a connecting section 18, a flange 20 and a steel mounting ring 22. The connection section 18 attaches to the end of a sewer pipe 16 while flange 20 engages the toilet drain 19. The connection section 16 can be a hub-type which extends over the end of sewer pipe 16 as illustrated in FIG. 6 or a spigot-type which extends into a hub fitting at the end of sewer pipe 16. Such connections are well known in the art.

Generally, a gasket 17, usually a wax ring, is positioned between the flange 20 and the toilet drain 19 to prevent leakage when the toilet is flushed. The connection section 18 and the flange 20 are generally of manufactured of ABS plastic and have a unitary construction.

To maintain the water closet coupling 12 in position, a continuous steel ring 22 having a U-shaped profile is employed which is mounted to a floor 15, to the toilet 19 and to the coupling 12. To mount to the coupling 12, the inner edge 21 of the steel ring 22 engages a channel 24 which extends circumferentially between the flange 20 and the connection section 18 on the exterior of the coupling 12.

For mounting to the floor 15, countersunk holes 26 are spaced about circumference of the ring 22. Matching screws 27 are inserted through hole 26 and screwed directly into the floor For mounting to the toilet drain 19, two arcuate slots 28 are positioned diametrically opposite each other in the ring 22. Nuts 29 and bolts 31 engage the slots 28 and corresponding slots 33 in the toilet 19. The head of the bolt 31 is positioned within the U-shaped profile of the ring. The U-shape of ring 22 is used to prevent warpage which would occur if the head of bolt 31 was positioned under a flat piece.

In general, ring 22 is about 1 inch wide with the U-shaped profile as best seen in FIG. 6. The inner edge 21 of ring 22 has a diameter of, preferably, about 2.5 inches.

Figure 1:
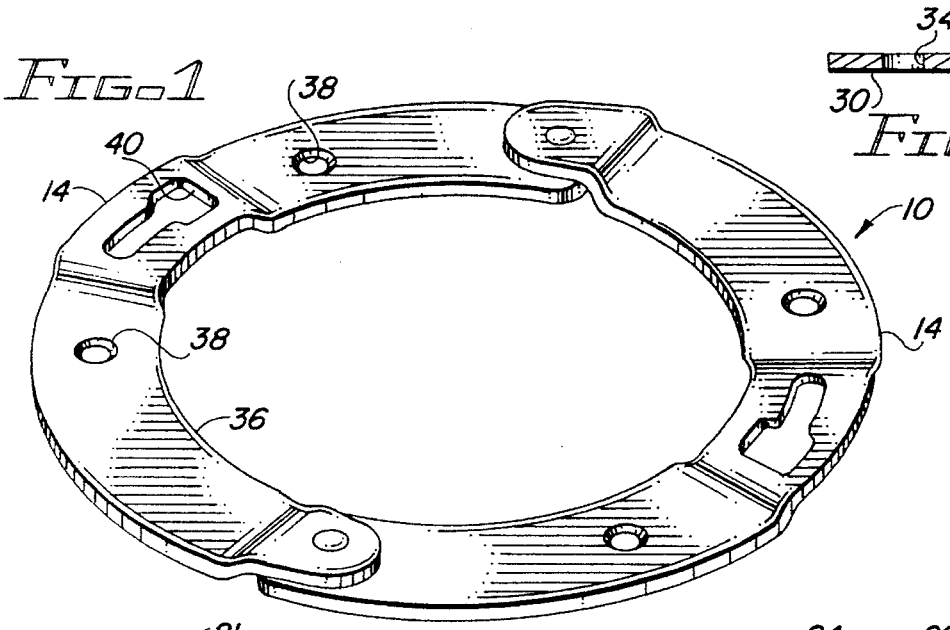
FIG. 1 is a perspective view of one embodiment of the present invention.
Figure 4:
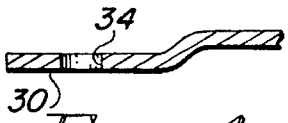
FIG. 4 is cross sectional view of FIG. 2 taken along line 4–4.
Figure 5:
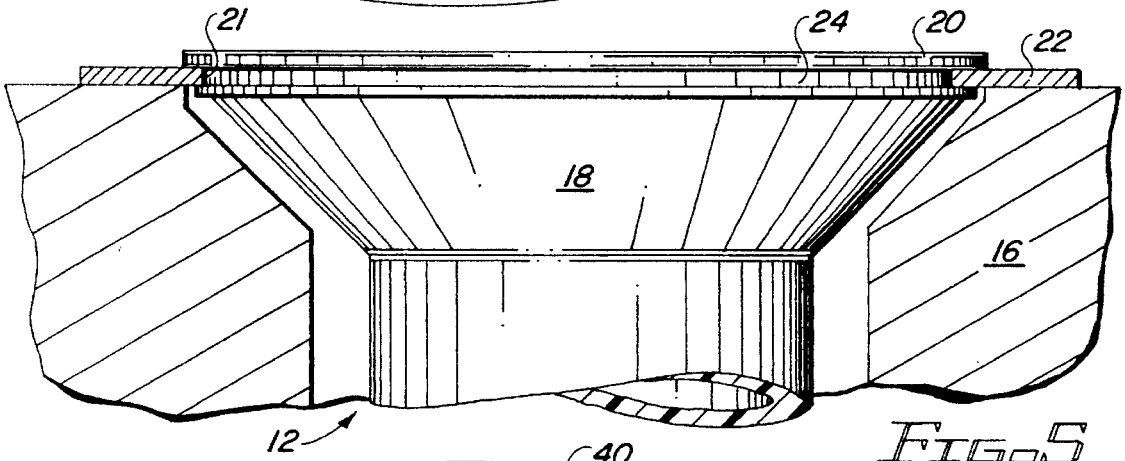
FIG. 5 is a side view of a closet coupling employing the present invention.
Figure 2:
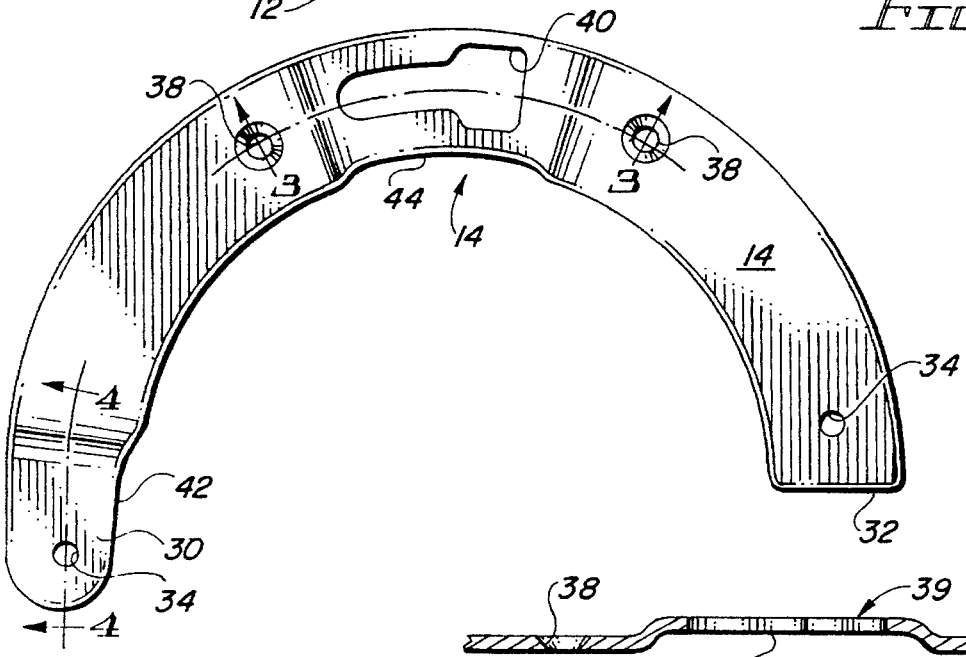
FIG. 2 is a top view of one arcuate piece of the embodiment of FIG. 1.

The present invention provides replacement ring 10 which comprises two opposing arcuate pieces 14. In the presently preferred embodiment of the invention, arcuate pieces 14 are identical in configuration. As shown in FIGS. 1, 2 and 4, each the arcuate piece has a stepped end 30 and a flat end 32. Each arcuate piece 14 extends beyond 180 degrees whereby stepped end 30 of one piece 14 overlaps flat end 32 of the second piece 14 when two such pieces are in opposition.

Preferably, 10–32 tapped holes 34 are drilled in both ends 30, 32 with the tapped hole 34 in the stepped end 30 mating with the corresponding hole 34 in the flat end 32 when overlapped as shown in FIG. 1.

Each arcuate piece 14 preferably has an inner edge 36 which engages channel 24 of coupling 12 in a manner equivalent to that of the original ring 22. In addition, countersunk holes 38 and arcuate slots 40 are positioned in the replacement ring 10 in the positions corresponding to the holes 26 and slots 28 previously described in connection with mounting the steel ring to the floor 15 and the toilet 19, respectively.

However, in contrast to the U-shaped profile of the original ring 22, each arcuate piece 14 is flat except for the stepped end 30 and a stepped up section 39 at the location of slot 40 corresponding to slot 28 in the original ring 22. The inner edges 42, 44 of both stepped end 30 and stepped up section 39, respectively, are also offset from the diameter of inner edge 36 to allow inner edge 36 to fully engage channel 24.

Figure 3:
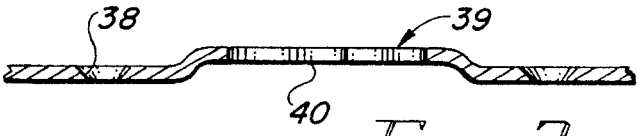
FIG. 3 is a cross sectional view of FIG. 2 taken along line 3—3.

Stepped up section 39 is best illustrated in FIG. 3. Preferably, section 39 is about 0.09 inches above the flat portion of arcuate piece 14. As does the U-shaped profile of ring 22, the stepped up section 39 allows the head of the bolt 31 to be positioned underneath the replacement ring 10 without warpage of the ring 10 caused by the weight of the toilet 19.

To use, the original steel ring 22 is first removed from the closet coupling 12. In general, ring 22 can be removed by simply grasping the same with a pair of pliers. Alternatively, ring 22 can be carefully cut off.

Two arcuate pieces 14 are positioned on opposing sides of the closet coupling 12 with the stepped end 30 of one piece being positioned underneath the corresponding flat end 32 of the second piece such that the tapped holes 34 are lined up. The inner edge 36 of the replacement ring 10 will engage the corresponding channel 24 which extends circumferentially around the closet coupling 12. Screws or other suitable securing means inserted in tapped holes 34 hold the two arcuate pieces 14 to form replacement ring 10 for the closet coupling 12. The replacement ring 10 is mounted to the toilet 19 and the floor using holes 38 and slots 40 corresponding to holes 26 and slots 28, respectively, in the original ring 22.

Although but one embodiment has been illustrated and described, it will be apparent to those skilled in the art that various changes and modifications may be made therein without departing from the spirit of the invention or from the scope of the appended claims.

What is claimed is:

1. A replacement ring for use in connection with a water closet coupling having a flange portion, a connection section and a mounting ring, the coupling being interposed between a toilet drain and a sewer pipe, the mounting ring including means for mounting the coupling to the toilet and means for mounting the coupling to a floor proximate to the sewer pipe, the inner diameter of the mounting ring engaging a channel on the coupling for mounting thereto, the replacement ring comprising:

two arcuate pieces positioned on opposing sides of the coupling, the inner diameter of the arcuate pieces engaging the channel on the coupling for mounting thereto after the mounting ring is removed therefrom, each arcuate piece further including a stepped end and a flat end, the stepped end of each piece overlapping the flat end of the opposing piece, the inner edge of the stepped end being offset from the inner diameter of the arcuate pieces;

means for joining the overlapping arcuate pieces to each other; and means for mounting the replacement ring to the toilet and means for mounting the replacement ring to the floor.

2. The replacement ring of claim 1 wherein the means for mounting the coupling to the floor and the means for mounting the replacement ring to the floor are identical.

3. The replacement ring of claim 2 wherein the means for mounting to the floor comprises countersunk holes.

4. The replacement ring of claim 1 wherein the means for mounting the replacement ring to the toilet comprises arcuate slots positioned in a stepped up portion of each arcuate piece.

5. The replacement ring of claim 1 wherein the means for joining the arcuate pieces comprises matching tapped holes in the overlapping stepped ends and flat ends.

6. The replacement ring of claim 1 wherein the connection section is a hub.

7. The replacement ring of claim 1 wherein the connection section is a spigot.

8. A replacement ring for use in connection with a water closet coupling having flange portion, a connection section and a mounting ring, the coupling being interposed between a toilet drain and a sewer pipe, the mounting ring including means for mounting the coupling to the toilet and means for mounting the coupling to a floor proximate to the sewer pipe, the inner diameter of the mounting ring engaging a channel on the coupling for mounting thereto, the replacement ring comprising:

two identical arcuate pieces positioned on opposing sides of the coupling, the inner diameter of the arcuate pieces engaging the channel on the coupling for mounting thereto after the mounting ring is removed therefrom, each arcuate piece including a stepped end and a flat end, the stepped end of each piece overlapping the flat end of the opposing piece, the inner edge of the stepped end being offset from the inner diameter of the arcuate pieces;

matching tapped holes positioned in the overlapping stepped ends and flat ends for joining the arcuate pieces;

countersunk holes for mounting the replacement ring to the floor; and arcuate slots positioned in a stepped up portion of each arcuate piece for mounting the replacement ring to the toilet.

9. A method of replacing a mounting ring for used in connection with a water closet coupling having flange portion, a connection section and the mounting ring, the coupling being interposed between a toilet drain and a sewer pipe, the mounting ring including means for mounting the coupling to the toilet and means or mounting the coupling to a floor proximate to the sewer pipe, the inner diameter of the mounting ring engaging a channel on the coupling for mounting thereto, the method comprising the steps of:

removing the mounting ring from the coupling;

positioning two overlapping arcuate pieces on opposing sides of the coupling, engaging the inner diameter of the arcuate pieces to the channel on the coupling for mounting thereto;

joining the overlapping arcuate pieces to each other;

mounting the replacement ring to the toilet; and mounting the replacement ring to the floor.

10. The replacement ring of claim 1 wherein the means for mounting the replacement ring to the toilet comprises arcuate slots positioned in each arcuate piece.

* * * * *